US005480315A

United States Patent [19]

Martinelli

[11] Patent Number: 5,480,315

[45] Date of Patent: Jan. 2, 1996

[54] RIGIDLY SECURABLE WATER RESISTIVE ELECTRICAL CONNECTOR

[76] Inventor: Leonard A. Martinelli, 628 Buena Vista, Lake Orion, Mich. 48362

[21] Appl. No.: 171,016

[22] Filed: Dec. 21, 1993

[51] Int. Cl.[6] ..... H01R 13/52

[52] U.S. Cl. ..... 439/271; 439/278; 439/587

[58] Field of Search ..... 439/275, 320, 439/309, 310, 598, 695, 701, 587, 578, 271

[56] References Cited

U.S. PATENT DOCUMENTS

| | | | |
|---|---|---|---|
| 2,322,491 | 6/1943 | Williams | 439/587 X |
| 3,112,973 | 12/1963 | Von Holtz | 439/701 X |
| 3,307,138 | 2/1967 | Swartz | 439/320 X |
| 3,601,761 | 8/1971 | Harris | 439/587 X |
| 3,778,535 | 12/1973 | Forney, Jr. | 439/320 X |
| 3,818,420 | 6/1974 | Barr . | |
| 3,885,849 | 5/1975 | Bailey et al. | 439/320 X |
| 4,060,299 | 11/1977 | Williams | 439/320 X |
| 4,322,123 | 3/1982 | Newell . | |
| 4,355,855 | 10/1982 | Rebikoff . | |
| 4,721,474 | 1/1988 | Kanno et al. . | |
| 4,761,146 | 8/1988 | Sohoel | 439/275 X |
| 4,801,277 | 1/1989 | Seilhan | 439/597 X |
| 4,822,293 | 4/1989 | Robson . | |
| 4,963,105 | 10/1990 | Lewis et al. | 439/578 OR |
| 5,018,987 | 5/1991 | Kirma . | |
| 5,080,601 | 1/1992 | Mennekes et al. . | |
| 5,114,359 | 5/1992 | Chishima et al. . | |
| 5,183,413 | 2/1993 | Lazaro, Jr. et al. | 439/587 X |
| 5,194,012 | 3/1993 | Cairns . | |
| 5,211,570 | 5/1993 | Bitney | 439/320 OR |

FOREIGN PATENT DOCUMENTS 2208338 3/1989 United Kingdom .

*Primary Examiner*—David L. Pirlot
*Assistant Examiner*—Daniel Wittels
*Attorney, Agent, or Firm*—Harness, Dickey & Pierce

[57] ABSTRACT

An electrical connector assembly including a first electrical connector and a second electrical connector connected therein in an electrical engagement. Each of the first and second electrical connectors including outer protective housings which are tapered from the connecting point between the first and second electrical connectors to opposite ends of each of the electrical connectors. Each of the protective housings includes internal bores in which is seated an electrical unit supporting electrical terminals and associated contacts in wires connected thereto. The wires extend from the electrical units through openings at opposite ends of the first and second electrical connectors. A threaded sleeve is threadably engagable with outer threads of the first and second connectors such that the first and second connectors are rigidly secured to each other.

16 Claims, 2 Drawing Sheets

RIGIDLY SECURABLE WATER RESISTIVE ELECTRICAL CONNECTOR

BACKGROUND OF THE INVENTION

1. Field of the Invention

This invention relates generally to an electrical connector assembly and, more specifically, to an electrical connector assembly having first and second connectors each including design features for reliably securing the first connector to the second connector and for maintaining the integrity of the connection against moisture.

2. Discussion of the Related Art

Electrical devices, such as power tools and the like, which run on alternating current and are portable in order to expand the range of use of the device include an electrical power cord for delivering power to the device. The power cord will include a connector electrically attached to the cord opposite to the device for connecting the cord to an alternating current power source. Typically, the electrical connector includes a three terminal configuration in which two terminals transfer the current to the electrical device, and the third terminal acts as a ground contact for safety purposes. As is well understood, an electrical connector of this type is engagable with a standard alternating current power outlet so as to provide the electrical power to the device. In this manner, the power cord can be disengaged from one electrical outlet and re-engaged to another electrical outlet in order to enable the electrical device to be used at many locations.

Because the power cord associated with the electrical device is usually significantly limited in length, electrical extension cords of differing lengths are available such that the electrical device can be used at increasing distances from the electrical outlet. As is well understood, an extension cord will include electrical connectors at opposite ends of the cord which are adapted to be matingly engaged with the connector of the power cord of the electrical device and the electrical outlet so as to provide the necessary electrical connection. Likewise, several extension cords can be attached in this manner to further extend the operating distance of the electrical device.

In many applications, such as in a construction environment, a portable electrical tool is moved from location to location within the range of the power cord and associated extension cords connected to the tool. As the portable tool is being moved from location to location, the cord or cords will be constantly encountering obstacles within the work area. Because the connectors at the ends of the power cords and the extension cords are larger in nature than the cord itself, and because these connectors incorporate a number of flat surfaces and hookable edges, the connectors get caught up on the obstacles and in some cases electrical power is disrupted to the tool because the electrical connectors are separated as a result of the tool operator attempting to pull the power cord to a desirable location. Therefore, the tool operator must stop his work and re-engage the separated connectors. This problem is exacerbated if the tool operator is at a location, such as on a platform, which is distant from the location where the electrical connection is disengaged.

Another problem relates to the ability of the connection between the connectors to provide a safe connection. As the cord is being dragged around in the work area when the tool operator moves from location to location, the connection between the connectors may encounter wet areas, such as puddles, which could cause water to enter the electrical connection area, thus causing a potentially unsafe area against electrocution. This also results in great inconvenience to the user of the tool since it often results in a blown fuse or circuit breaker which must be repaired or reset before continuing work.

What is needed then is an electrical connector assembly in which engagable connectors are rigidly secured such that a relatively large amount of force will not separate the electrical connection, and wherein the electrical connection is safe from infiltration by moisture. It is therefore an object of the present invention to provide such an electrical connector assembly.

SUMMARY OF THE INVENTION

In accordance with the teachings of the present invention, an electrical connector assembly is disclosed for connecting electrical power cords. The connector assembly includes a first connector having electrical terminal prongs and a second connector having electrical terminal contacts which accept the terminal prongs such that the first connector is adaptable to engage the second connector in an electrical connection. Each of the terminal prongs and the terminal contacts are electrically connected to associated power cords including wires for each prong and contact. Each of the connectors includes an insulative housing that surrounds the connections between the wires and the terminals or the wires and the terminal contacts.

Each of the first and second electrical connectors further includes a cylindrical protective housing enclosing the insulative housing. The protective housing is bored out such that the insulative housing of the respective connector is slidably inserted and rigidly secured within the bore proximate one end of the protective housings and the associated cord extends from the other end. The protective housing further includes an outer threaded portion proximate the bore opening through which the insulative housing is inserted. A cylindrical collar is threadably engaged to the threaded portions of both of the protective housings in order to rigidly secure the electrical connectors together. One of the electrical connectors includes a rubber O-ring seated within a channel at one end of the connector such that when the first and second electrical connectors are engaged, the O-ring seats against the other electrical connector so as to provide a water-tight seal for the electrical connection. Each of the protective housings are tapered from the end of the housing where the connection is made to an opposite end from which the cord extends so as to help prevent hang ups on obstacles in a work area.

Additional objects, advantages, and features of the present invention will become apparent from the following description of the appended claims, taken in conjunction with the accompanying drawings.

DETAILED DESCRIPTION OF THE PREFERRED EMBODIMENTS

The following discussion of the preferred embodiments concerning an electrical connector assembly is merely exemplary in nature and is in no way intended to limit the invention or its applications or uses.

Figure 1:
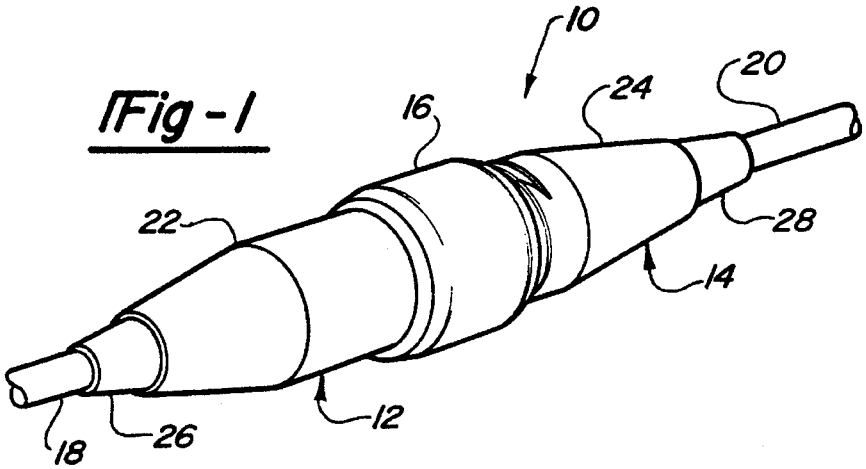
FIG. 1 is a perspective view of an electrical connector assembly according to a preferred embodiment of the present invention.

First turning to FIG. 1, a perspective view of an electrical connector assembly 10 according to a preferred embodiment of the present invention is shown. The connector assembly 10 includes a first connector 12 and a second connector 14 engaged in an electrical connection. The first connector 12 and the second connector 14 are rigidly secured together by a collar 16 such that the collar 16 encloses connecting ends of the connectors 12 and 14 in a manner that will be discussed in detail below. A power cord 18 extends from an end of the connector 12 opposite to the connector 14. A power cord 20 extends from an end of the connector 14 opposite to the connector 12. The first connector 12 and the second connector 14 each include electrical contacts (shown below) such that when the connectors 12 and 14 are engaged, an electrical connection between the power cord 18 and the power cord 20 is achieved.

The first connector 12 and the second connector 14 are tapered such that they have a wider diameter at the end which they contact each other and a narrower diameter proximate the end from which the cords 18 and 20 extend. The tapered configuration of the connector 12 is defined by an outer protective housing 22. Likewise, the tapered configuration of the connector 14 is defined by an outer protective housing 24. A tip member 26 extends from the outer housing 22 at the end of the first connector 12 opposite to the second connector 14, and the power cord 18 extends through an opening in the tip member 26. Likewise, a tip member 28 extends from the housing 24 at the end of the second connector 14 opposite to the connector 12, and the power cord 20 extends through an opening in the tip member 28. In a preferred embodiment, the protective housings 22 and 24 are made of a rigid nylon material. The tip members 26 and 28 are made of a softer nylon or rubber material such that the power cords 18 and 20 can be flexed against the tip members 26 and 28, respectively, without causing damage to the cords 18 and 20.

Figure 2:
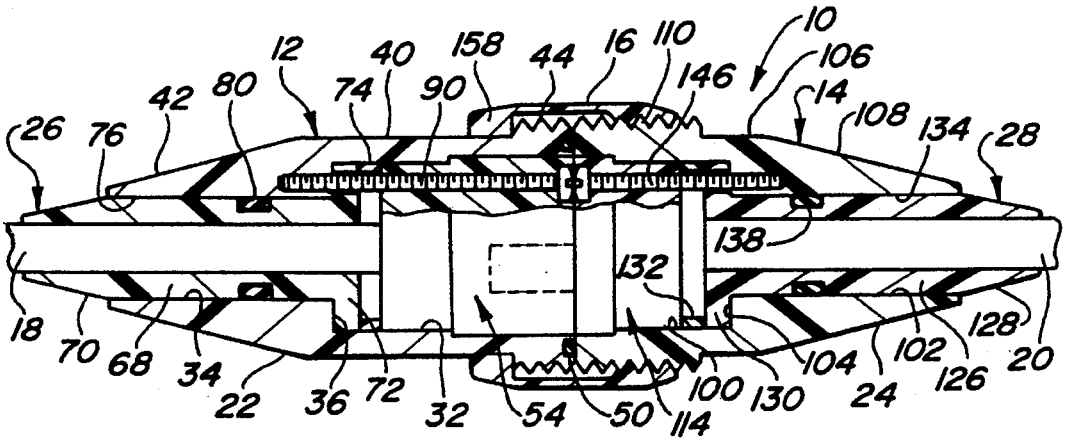
FIG. 2 is a cutaway side view of the electrical connector assembly of FIG. 1.
Figure 3:
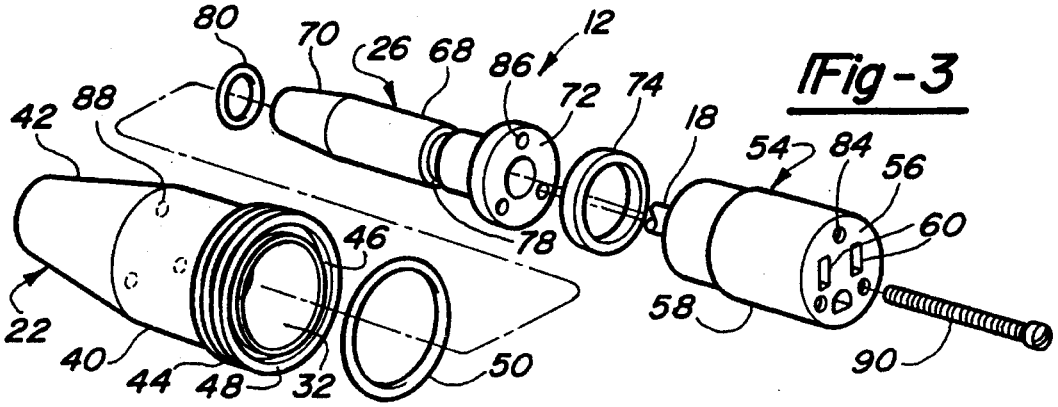
FIG. 3 is an exploded perspective view of a first connector of the electrical assembly of FIG. 1.

FIG. 2 shows a cross sectional view of the connector assembly 10. FIG. 3 shows an exploded perspective view of the first connector 12. By viewing these two figures, the specific components and features of the first connector 12 can be seen. The outer protective housing 22 is cylindrical in nature and defines a first bore 32 and a second bore 34 extending completely through the housing 22. The first bore 32 has a larger diameter than the second bore 34 such that a shoulder 36 is formed therebetween. The housing 22 includes a barrel portion 40 and a tapered portion 42. A series of external threads 44 are integral with the housing 22 at one end. The barrel portion 40 is approximately the same length as the bore 32, and the tapered portion 42 is approximately the same length as the bore 34. A circumferential ring groove 46 is formed in an end face 48 of the housing 22 proximate to the external threads 44. An O-ring 50 is seated within the groove 46, and contacts the electrical connector 14 in a water-tight manner which will be discussed in greater detail below.

An electrical unit 54 is seated within the first bore 32 in a friction fit such that a front face 56 of the electrical unit 54 is substantially flush with the front face 48 of the housing 22. The electrical unit 54 includes an insulative housing 58 for electrically insulating a series of terminal contacts 60. The terminal contacts 60 include two alternating current contacts and a ground contact, as is well understood in the art. The power cord 18 consists of three electrical wires (not shown) which are electrically connected to the contacts 60 in a manner that is also well understood in the art. The power cord 18 extends from a back surface of the electrical unit 54 opposite to the front surface 56.

The tip member 26 is seated within the second bore 34 in a friction fit. The material of the tip member 26 and the friction fit within the second bore 34 prevents water from entering the housing 22. The tip member 26 includes an elongated portion 68 extending through the bore 34 and connecting a tapered tip portion 70 and a lip portion 72. The tapered tip portion 70 extends from the housing 22 opposite to the front face 48, and the lip portion 72 rests against the shoulder 36 within the bore 32. A ringed spacer member 74 is in contact with and separates the lip portion 72 of the tip member 26 from the electrical unit 54. The combinational width of the lip portion 72, the spacer member 74 and the electrical unit 54 make up the length of the bore 32. The electrical unit 54 applies pressure against the spacer member 74, which in turn forces the lip portion 72 against the shoulder 36 in a water tight engagement. The power cord 18 extends through the spacer member 74 and through an internal bore 76 extending through the tip member 26. The internal bore 76 can be of varying diameters in order to accommodate different sized power cords. A circumferential groove 78 is formed around a central area of the elongated portion 68. A ringed member 80, including but not limited to a zip strap, a crimpable hose clamp, or an o-ring, is seated within the groove 78 such that the ringed member 80 is tightened in the groove 78 in order to apply pressure against the cord 18 so that the cord 18 is snugly secured within the elongated portion 68 in a water resistant manner.

A series of three holes 84 extend through the insulative housing 58. Additionally, a series of three holes 86 extends through the lip portion 72 of the tip member 26 and are aligned with the holes 84 in the insulative housing 58. Further, a series of three threaded holes 88 are positioned within the shoulder 36 of the housing 22 and are also aligned with the holes 84 and 86. A series of three bolts 90, only one of which is shown, extend through the holes 84 in the insulative housing 58, through the ring spacer member 74, through the holes 86 in the lip portion 72, and are threadably engaged with the threaded holes 88 in the shoulder 36. In this manner, the electrical unit 54 and the tip member 26 are secured to the housing 22.

Figure 4:
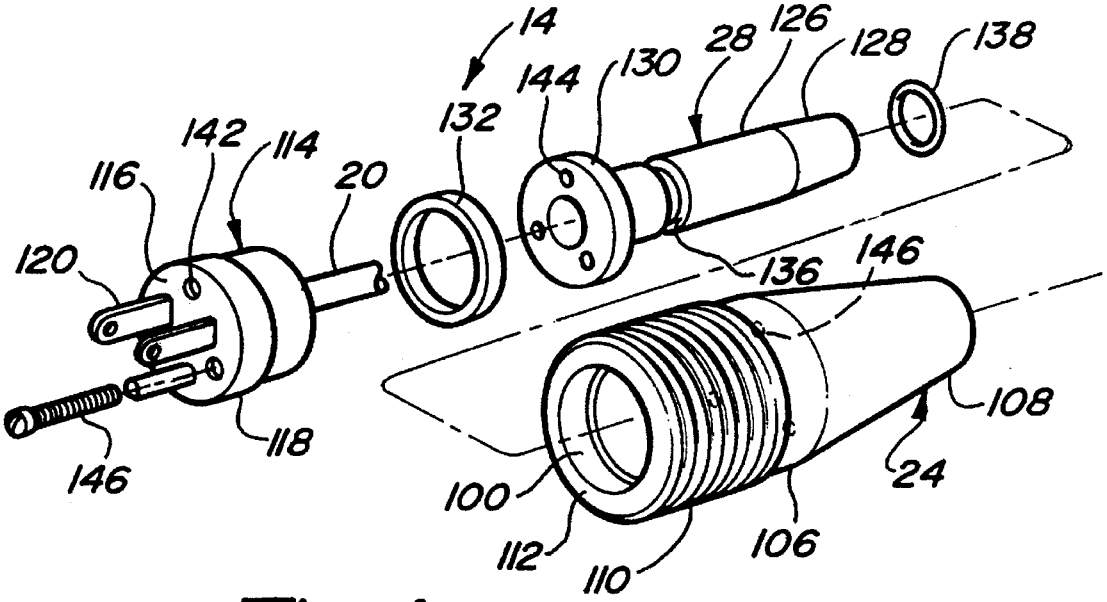
FIG. 4 is an exploded perspective view of a second connector of the connector assembly of FIG. 1.

FIG. 4 shows an exploded perspective view of the second connector 14. By viewing FIGS. 2 and 4, the specific components and features of the second connector 14 can therefore be seen. The outer protective housing 24 is cylindrical in nature and defines a first bore 100 and a second bore 102 extending completely through the housing 24. The first bore 100 has a larger diameter than the second bore 102 such that a shoulder 104 is formed therebetween. The housing 24 includes a barrel portion 106 and a tapered portion 108. A series of external threads 110 are integral with the barrel portion 106 proximate a front face 112. The barrel portion 106 is approximately the same length as the bore 100.

An electrical unit 114 is seated within the first bore 100 in a friction fit such that a front face 116 of the electrical unit 114 is substantially flush with the front face 112 of the housing 24. The electrical unit 114 includes an insulative housing 118 for electrically insulating a series of three terminal prongs 120. The terminal prongs 120 include two alternating current contacts and a ground contact, as iS well understood in the art. The power cord 20 consists of three electrical wires (not shown) which are electrically connected to the terminal prongs 120 in a manner that is also well understood in the art. The cord 20 extends from a back surface of the electrical unit 114 opposite to the front surface 112. As can be seen in FIG. 2, the base portion 106 of the housing 24 is somewhat shorter than the base portion 40 of the housing 22. This is because the electrical unit 114 is somewhat shorter than the electrical unit 54.

The tip member 28 is seated within the second bore 102 in a friction fit. The material of the tip member 28 and the friction fit within the bore 102 prevents water from entering the housing 24. The tip member 28 includes an elongated portion 126 extending through the bore 102 and connecting a tapered tip portion 128 and a lip portion 130. The tapered tip portion 128 extends from the housing 204 opposite to the front face 112, and the lip portion 130 rests against the shoulder 104 within the bore 100. A ring spacer member 132 is in contact with and separates the lip portion 130 from the electrical unit 114. The combinational width of the lip portion 130, the spacer member 132 and the electrical unit 114 make up the length of the bore 100. The electrical unit 114 applies pressure against the spacer member 132, which in turn forces the lip portion 130 against the shoulder 104 in a water tight manner. The power cord 20 extends through the spacer member 132 and through an internal bore 134 extending through the elongated portion 126 of the tip member 28. The internal bore 134 can be of varying diameters in order to accommodate different sized power cords. A circumferential groove 136 is formed around a central location of the elongated portion 126. A ring member 138, including but not limited to a zip strap, a crimpable hose clamp, or an O-ring, is seated within the groove 136 such that the member 138 forces pressure against the cord 20 so as to be snugly secured within the elongated portion 126 in a water resistant manner.

A series of three holes 142 extend through the insulative housing 114. Additionally, a series of three holes 144 extend through the lip portion 130 of the tip member 30 and are aligned with the holes 142. Further, a series of three threaded holes 146 are threaded within the shoulder 104, and are aligned with the holes 142 and 144. A series of three bolts 148, only one of which is shown, extend through the holes 142, within the ringed spacer member 132, through the holes 144, and are threadably secured within the threaded holes 146 so as to rigidly secure the electrical unit 114 and the tip member 28 to the housing 24.

Figure 5:
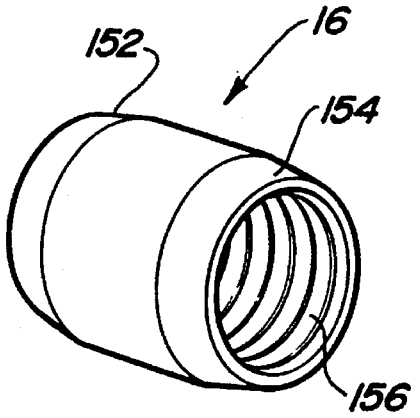
FIG. 5 is a perspective view of a collar of the electrical connector assembly of FIG. 1.

FIG. 5 shows a perspective view of the collar 16. As is apparent, the collar 16 is a hollow cylinder. One end of the collar 16 includes a tapered portion 152 and an opposite end of the collar 16 includes a tapered portion 154. A threaded portion 156 is integral with the underside of the collar 16 at the tapered end 154 and a circumferential lip 158 is integral with the inside of the collar 16 at the tapered end 152. The threaded portion 156 is of such a diameter that it can be slipped over the base portion 40 of the housing 22. In a preferred embodiment there are six threads per inch for the threaded portion 156, however, the number of threads could vary from about 3 and to about 10 threads per inch for the threaded portion 156.

The first connector 12 and the second connector 14 are connected in the following manner. Prior to the first connector 12 being connected to the second connector 14, the threaded portion 156 is threadably engaged with the threaded portion 44 of the housing 22. The terminals 120 of the second connector 14 are then inserted into the appropriate terminal contacts 60 of the first connector 12, in a manner that is well understood in the art. The collar 16 is then rotated such that the threaded engagement between the threaded portion 156 and the threaded portion 40 advances the collar 16 towards the second connector 14. As the collar 16 is rotated, the threaded portion 156 will eventually threadably engage the threaded portion 106 of the housing 24. As the collar 16 is further advanced, the lip portion 158 will eventually contact the threaded portion 44 of the housing 24 as shown in FIG. 2. When this happens, the front face 112 of the housing 26 will be drawn towards the front face 48 of the housing 22, and the O-ring 50 will be seated against the front face 112 of the housing 24 in a water tight engagement. The first connector 12 will then be rigidly secured to the second connector 14 in a water resistant manner. It will be readily appreciated that the collar 16 will be threadably engaged to the threaded portion 44 in order to prevent the collar 16 from slipping off of the housing 22 when the first connector 12 is disconnected from the second connector 14. The tapered configuration of the housing 22 and the housing 24, as well as the collar 16, significantly prevents the connector assembly 10 from hanging up on obstacles as it is being drug through a work area.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. An electrical connector assembly comprising:

a first electrical connector, said first connector including a first electrical unit having a first electrical cable extending therefrom, said electrical unit including at least one extended electrical terminal electrically connected to the first electrical cable, said first connector further including a first insulative protective housing having a first end and a second end, said insulative housing including an internal bore passing therethrough, wherein the first electrical unit is seated within the bore at the first end of the housing and the first cable extends from the bore at the second end of the housing, said first housing being configured in a tapered format such that a diameter of the housing at the first end is larger than a diameter of the housing at the second end;

a second electrical connector, said second electrical connector including a second electrical unit having a second electrical cable extending therefrom, said second electrical unit including at least one electrical connector electrically connected to the second electrical cable and being adaptable to receive the at least one extended electrical terminal in an electrical engagement, said second electrical connector further including a second insulative protective housing having a first end and a second end, said second insulative housing including an internal bore passing therethrough, wherein said second electrical unit is seated within the bore at the first end of the second housing and the second cable extends from the bore at the second end of the housing, said second housing being configured in a tapered format such that diameter of the second cylindrical housing at the first end is wider than the diameter at the second end;

the first electrical connector further includes a first tip member and the second electrical connector further includes a second tip member, said first tip member being seated within the internal bore of the first housing and said second tip member being seated within the internal bore of the second housing, said first tip member including an internal bore for accepting the first cable from the first electrical unit such that the first electrical cable extends through the tip member and out of the first connector and said second tip member including an internal bore for accepting the second cable from the second electrical unit such that the second electrical cable extends through the second tip member and out of the second connector, said first and second tip members are formed of a sealing material for sealing said cables and housing in a water-tight manner; and a sealing ring, said sealing ring being seated within a circumferential channel within a front face of the first insulative housing, said front face being positioned transverse to said internal bore and being adaptable to engage a front face, positioned transverse to said internal bore, of the second housing to form a water resistive seal.

2. The electrical connector assembly according to claim 1 further comprising a cylindrical collar, said cylindrical collar including an internal threaded portion which is threadably engagable with an external threaded portion proximate to the first end of the first connector and an external threaded portion proximate to the first end of the second connector such that the first and second electrical connectors are rigidly secured together.

3. The electrical connector assembly according to claim 2 wherein the internal bore of the first housing is separated into a first bore and a second bore, where the first bore has a wider diameter than the second bore such that a shoulder is formed therebetween, and the internal bore of the second housing is separated into a first bore and a second bore, where the first bore of the second housing has a wider diameter than the second bore of the second housing such that a shoulder is formed therebetween, and wherein the first tip member includes a first lip portion, a first elongated portion and a first tip portion, said first lip portion being positioned within the first bore of the first housing against the shoulder, said first elongated portion extending through the second bore of the first housing, and the first tip portion extending out of the first housing, and the second tip member includes a second lip portion, a second elongated portion and a second tip portion, said second tip portion being positioned within the first bore of the second housing against the shoulder, said second elongated portion extending through the second bore of the second housing, and the second tip portion extending out of the second housing.

4. The electrical connector assembly according to claim 3 wherein the first elongated portion of the first tip member includes a first circumferential groove extending around the first elongating portion, wherein a first elastic strap is secured within the first circumferential groove in order to secure the first tip member to the first cable in a water tight manner, and the second elongated portion of the second tip member includes a second circumferential groove extending around the second elongated portion, wherein a second elastic strap is secured within the second circumferential groove in order to secure the second tip member to the second cable in a water tight manner.

5. The electrical connector assembly according to claim 3 wherein the first connector includes a ring spacer member positioned between the first lip portion of the first tip member and the first electrical unit within the first bore of the first housing, and the second connector includes a second ring spacer member positioned between the second lip portion of the second tip member and the second electrical unit within the first bore, wherein the first electrical cable extends within the first ring spacer member and the second electrical cable extends within the second ring spacer member.

6. The electrical connector assembly according to claim 3 wherein the first and second housings are made of a rigid material and the first and second tip members are made of a material which is substantially more flexible than the first and second housing.

7. An electrical connector comprising:

an outer insulative protective housing, said insulative housing defining an internal bore extending therethrough, said insulative housing including a first end and a second end;

an electrical unit positioned within the internal bore of the housing such that a front face of the electrical unit is substantially flush with a front face at the first end of the housing, said electrical unit including at least one electrical contact being electrically connected to an electrical cable, said electrical cable extending from a back surface of the electrical unit and out of the second end of the housing; and a tip member positioned within the internal bore of the housing such that a tip portion of the tip member extends from the second end of the housing, said tip member defining an internal bore such that the electrical cable passes through the internal bore of the tip member and said tip member of a sealing material for sealing said cable and housing in a water-tight manner, said tip member having a first tip portion extending from the second end of the housing wherein said tip portion is configured in a tapered format such that a diameter of the first tip portion proximate the second end of the housing is of a greater diameter than an opposite end of the tip portion and a sealing ring, said sealing ring being seated within a circumferential channel within a front face of the first insulative housing, said front face being positioned transverse to said internal bore and being adaptable to engage a front face, positioned transverse to said internal bore, of the second housing to form a water resistive seal.

8. The electrical connector according to claim 7 wherein the outer insulative housing is configured in a tapered format such that the first end of the housing is of one diameter and the second end of the housing is of a smaller diameter, and wherein the tip portion of the tip member is also configured in a tapered format such that a diameter of the tip member proximate the second end of the housing is of a greater diameter than an opposite end of the tip portion.

9. The electrical connector according to claim 7 wherein the bore within the insulative housing is separated into a first bore and a second bore where the first bore has a wider diameter than the second bore such that a shoulder is formed therebetween, and wherein the tip member includes a lip portion and an elongated portion, said lip portion being positioned within the first bore against the shoulder and the elongated portion extending through the second bore.

10. The electrical connector assembly according to claim 9 wherein the elongated portion of the tip member includes a circumferential groove extending around the elongated portion, wherein an elastic strap is secured within the circumferential groove in order to secure the tip member to the cable in a water tight manner.

11. The electrical connector assembly according to claim 9 further comprising a ring spacer member positioned between the lip portion and the electrical unit within the first bore, wherein the electrical cable extends within the ring spacer member.

12. An electrical connector assembly comprising:

a first electrical connector including a first insulative protective housing having a first end and a second end, said first insulative housing being cylindrical in nature and including an internal cylindrical bore passing therethrough, said first insulative housing further including a barrel portion at the first end of the first housing and a cone shaped portion at the second end of the first housing, said barrel portion including an integral threaded portion, wherein an electrical unit is positioned in the internal bore within the barrel portion;

a second electrical connector including a second insulative protective housing having a first end and a second end, said second insulative housing being cylindrical in nature and including an internal cylindrical bore passing therethrough, said second insulative housing further including a barrel portion at the first end of the first housing and a cone shaped portion at the second end of the second housing, said barrel portions including an integral threaded portion, wherein an electrical unit is positioned in the internal bore within the barrel portion;

a cylindrical sleeve having a first end and a second end, wherein a first end and a second end of the cylindrical sleeve includes a tapered portion, said cylindrical sleeve including an internal integral threaded portion and an internal integral lip portion such that the internal threaded portion is threadably engagable with the threaded portion of the barrel portions of the first and second electrical connectors in order to secure the first and second electrical connectors together such that the electrical unit of the first connector and the electrical unit of the second connector are engaged in an electrical connection;

wherein the first electrical connector includes a tip member extending from the second end of the first housing, and the second electrical connector includes a tip member extending from the second end of the second connector, wherein the first and second tip members are made of a sealing material which is less rigid than the first and second insulative housings for sealing said cable with said housings in a water-tight manner; and a sealing ring, said sealing ring being seated within a circumferential channel within a front face of the first insulative housing, said front face being positioned transverse to said internal bore and being adaptable to engage a front face, positioned transverse to said internal bore, of the second housing to form a water resistive seal.

13. The electrical connector assembly according to claim 12 wherein the tip member of the first electrical connector is seated within the internal bore of the first protective housing and the tip member of the second electrical connector is seated within the internal bore of the second protective housing, wherein an electrical cable associated with the electrical unit of the first connector extends through an internal bore of the tip member of the first connector and out of the second end of the first connector, and a cable associated with the electrical unit of the second connector extends through an internal bore of the tip member of the second connector and out of the second end of the second connector.

14. An electrical connector according to claim 1, wherein said tip members include an outer circumferential groove and a member in said groove for securing said cord within said tips.

15. An electrical connector according to claim 7, wherein said tip member includes an outer circumferential groove and a member in said groove for securing said cord within said tip.

16. An electrical connector according to claim 12, wherein said tip members include an outer circumferential groove and a member in said groove for securing said cord within said tips.

* * * * *